United States Patent [19]

MacKay, Jr.

[11] Patent Number: 4,896,463

[45] **Date of Patent: * Jan. 30, 1990**

[54] DISPOSABLE FINISHING ARTICLE HAVING AN INTEGRAL MOUNTING HUB INCLUDING PRESSURE CAP SECURED BY ROTATION

[76] Inventor: Joseph H. MacKay, Jr., 17551 Cabela Dr., San Diego, Calif. 92127

[ * ] Notice: The portion of the term of this patent subsequent to Jul. 5, 2005 has been disclaimed.

[21] Appl. No.: 181,773

[22] Filed: Apr. 15, 1988

Related U.S. Application Data

[63] Continuation-in-part of Ser. No. 113,937, Oct. 27, 1987, Pat. No. 4,754,577, which is a continuation-in-part of Ser. No. 5,813, Jan. 21, 1987, Pat. No. 4,754,578, which is a continuation of Ser. No. 847,793, Apr. 3, 1986, Pat. No. 4,694,615.

[51] Int. Cl.[4] ..... B24B 45/00

[52] U.S. Cl. ..... 51/168; 51/209 R; 51/378; 15/98; 15/230.19

[58] Field of Search ..... 51/168, 209 R, 358, 51/376, 377, 378, 389, 391, 392, 393; 15/230.18, 230.19, 98; 411/368, 369, 508, 533, 542, 544

[56] References Cited

U.S. PATENT DOCUMENTS

| | | | |
|---|---|---|---|
| 489,149 | 1/1893 | Hyde | 51/168 |
| 2,633,008 | 3/1953 | Torri-Guilbert | 51/168 X |
| 2,990,661 | 7/1961 | Hackett | 51/379 |
| 3,623,281 | 11/1971 | Moffat | 51/377 |
| 4,245,438 | 1/1981 | van Buren, Jr. | 51/377 |
| 4,322,920 | 4/1982 | Wells | 51/376 X |
| 4,449,329 | 5/1984 | Sauerwein et al. | 51/168 |
| 4,754,577 | 7/1988 | MacKay, Jr. | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable finishing article for mounting on a rotatable threaded spindle of a power tool. The finishing article contains a retaining nut on one side and a backing flange on the other non-removably secured together on the finishing article without the aid of the adhesives in such a manner that the finishing article is placed in compression when it is operably secured upon the spindle of the power tool under operative loads. The nut and flange are secured together by upsetting one end of the nut causing it to protrude outwardly over the outer surface of the flange. A pressure cap member is secured by rotation to a plurality of fingers formed on the backing flange for engaging a shoulder formed on the spindle of the power tool during operation of the finishing article.

14 Claims, 3 Drawing Sheets

FIG. 1
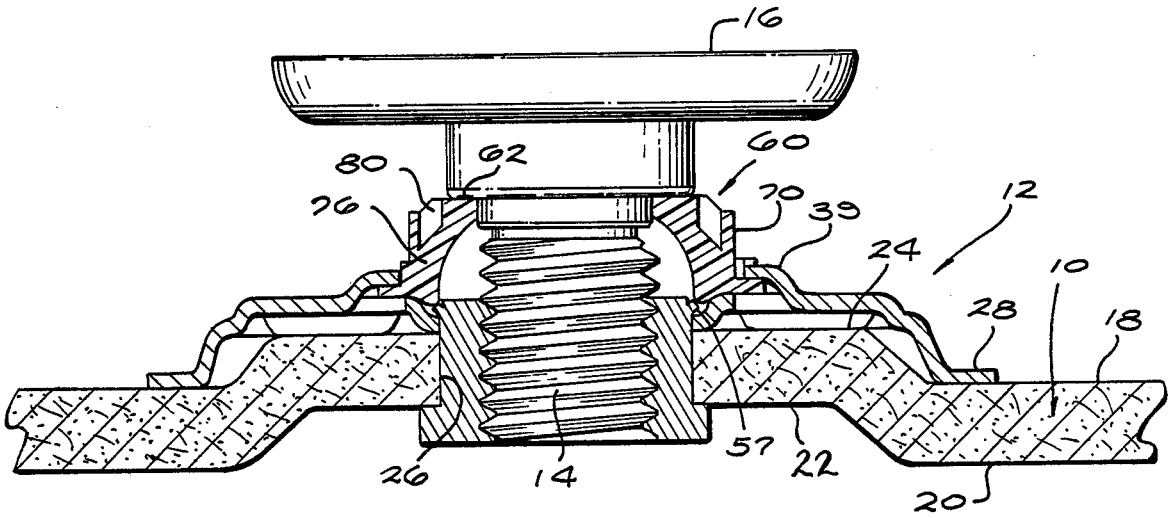
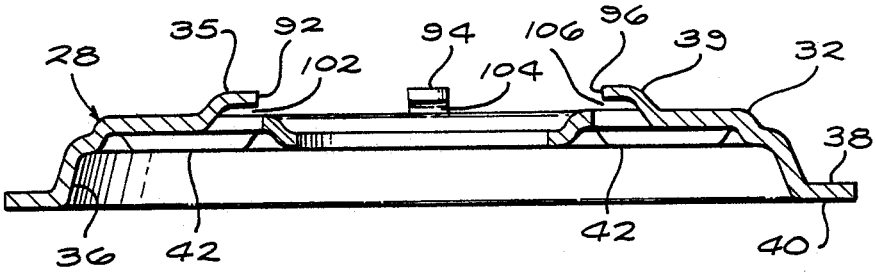
FIG. 3
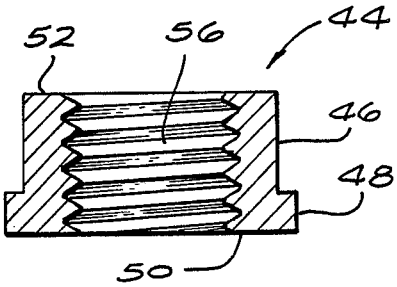
FIG. 4
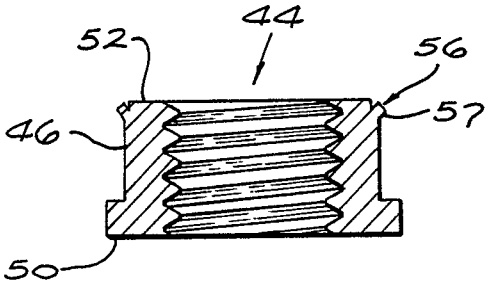
FIG. 5

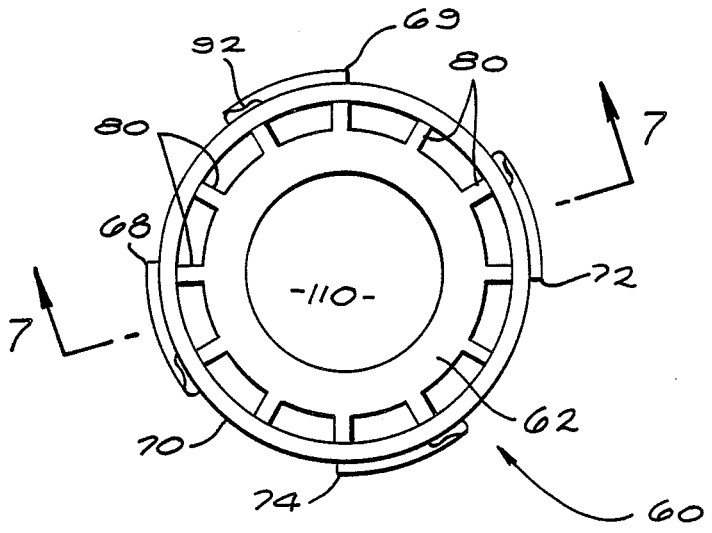
FIG. 6
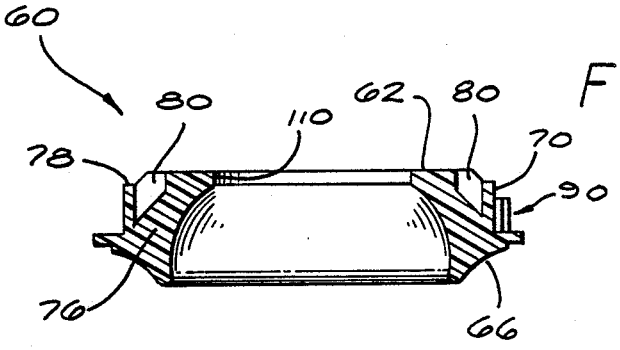
FIG. 7
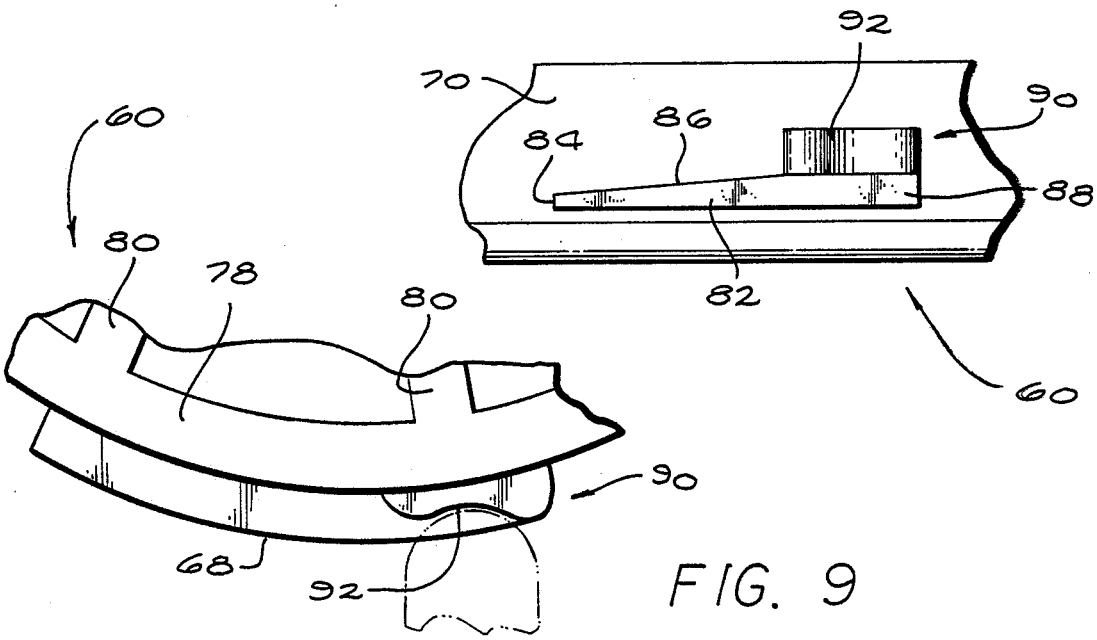
FIG. 8
FIG. 9

DISPOSABLE FINISHING ARTICLE HAVING AN INTEGRAL MOUNTING HUB INCLUDING PRESSURE CAP SECURED BY ROTATION

RELATED APPLICATION

This application is a continuation-in-part of U.S. patent application Ser. No. 113,937 filed Oct. 27, 1987 for DISPOSABLE FINISHING ARTICLE HAVING AN INTEGRAL MOUNTING HUB INCLUDING AN IMPROVED PRESSURE CAP now U.S. Pat. No. 4,754,577 which is a continuation-in-part of U.S. patent application Ser. No. 005,813 filed Jan. 21, 1987 for DISPOSABLE DEPRESSED CENTER GRINDING WHEEL HAVING AN INTEGRAL MOUNTING HUB INCLUDING A PRESSURE CAP now U.S. Pat. No. 4,754,578 which is a continuation in part of Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to finishing articles and more particularly to such articles having a mounting hub permanently affixed thereto with the combination adapted for quick attachment and release to an appropriate portable power tool.

BACKGROUND OF THE INVENTION

The use of rotatably driven finishing articles is widespread and familiar in our industrial society. One of the more serious problems encountered in the use of such devices resides in the provision of effective means for preventing undesired or accidental disassociation of the article from the shaft, spindle or other rotatable drive means on which it is mounted. This problem is particularly acute when the connection between the article and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 489,149; 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100, 3,210,892 and 3,621,621.

The devices utilized in the prior art for providing the disposable finishing article assembly including the permanent by affixed mounting hub generally provide the service intended. There are certain inherent disadvantages found with regard to the various devices. Such disadvantages are that in manufacturing the utilization of an adhesive adds additional material and labor to the cost. In certain of the devices, parts must be keyed together and properly aligned in order to function appropriately. In addition thereto, through the utilization of die-cast mounting hubs which include as an integral part the backing flange there is no additional clamping force exerted upon the finishing article as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a rotatable spindle of a power tool. The drive member includes a backing flange having gripping fingers radially inwardly extending therefrom secured by a retaining nut positioned on the opposite side from the backing flange. The retaining nut extends through an opening in the finishing article from one side thereof to the other and has a radial flange at one end thereof seated against the one side of the finishing article and protrusion means extending outwardly from the other end thereof for non-removably securing the retaining nut and the backing flange together on the finishing article without the use of adhesives. A pressure cap defining a central opening is held in place by a plurality of radially outwardly extending tangs secured by the gripping fingers on the backing flange. The pressure cap extends longitudinally away from the backing flange to engage the power tool spindle seat for placing the finishing article in compression during use thereof when the finishing article is operatively secured upon the spindle of the power tool.

BRIEF DESCRIPTION OF THE DRAWINGS

FIG. 1 a cross sectional view of a finishing article assembly constructed in accordance with the principles of the present invention and mounted in operable position on the spindle of a power tool:

FIG. 3 a cross sectional view taken about the lines 3-3 FIG. 2 of a backing flange constructed in accordance with the present invention;

FIG. 4 is a cross sectional view of a retaining nut constructed in accordance with the principles of the present invention;

FIG. 5 is a cross sectional view of the retaining nut of FIG. 5 after being upset;

FIG. 6 is atop plan view of a pressure cap constructed in accordance with the present invention;

FIG. 7 is a cross sectional view taken about the line 7-7 of FIG. 6 showing construction of the pressure cap;

FIG. 8 is a fragmentary elevational view showing the construction of a tang in greater detail; and FIG. 9 is a fragmentary top plan view showing the cooperative relationship between a finger and a locking detent on the pressure cap.

DETAILED DESCRIPTION

Figure 2:
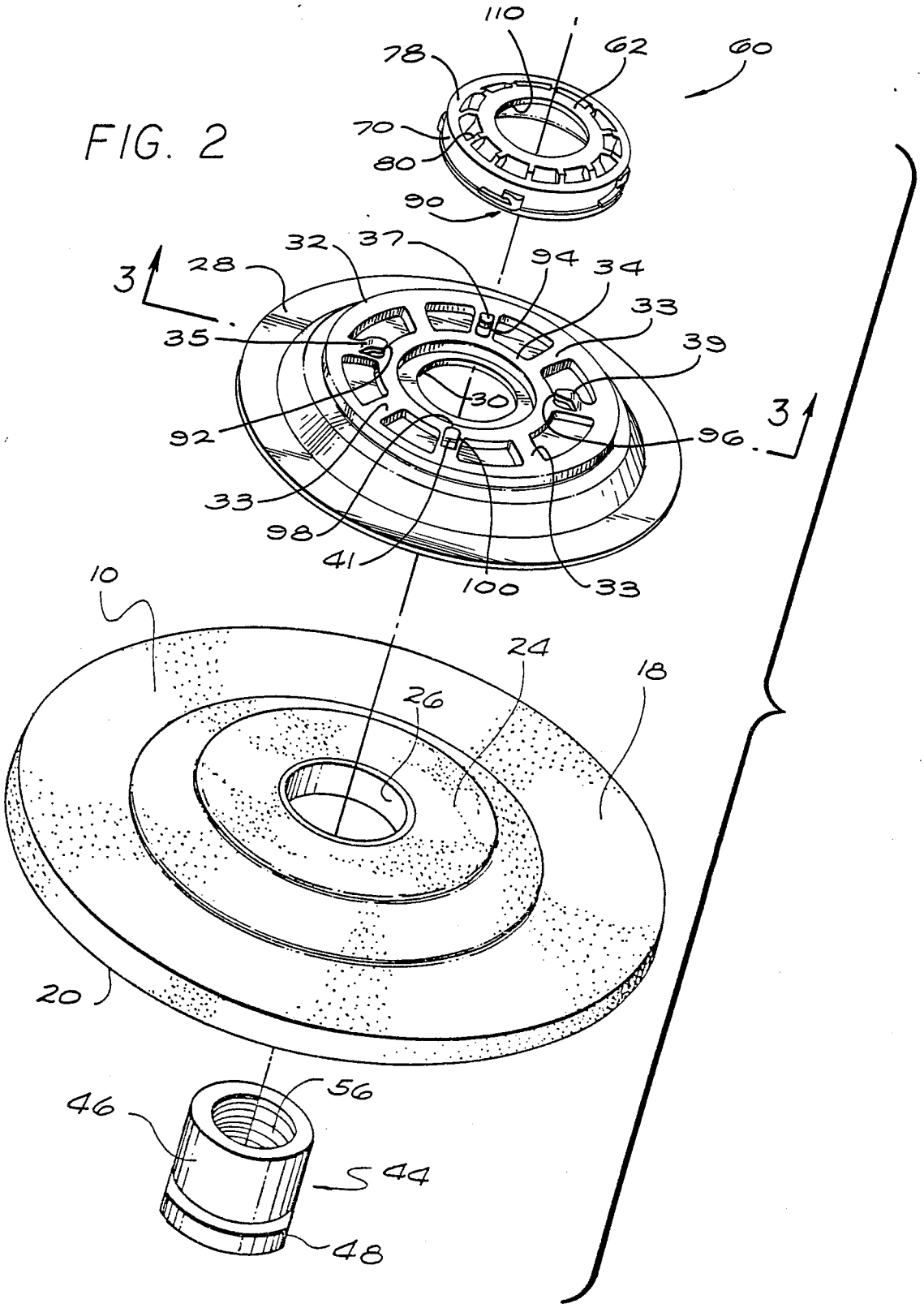
FIG. 2 is an exploded view of the structure as illustrated in FIG. 1.

By reference now to FIGS. 1 through 9, there is illustrated a preferred embodiment of a disposable finishing article drive member assembly constructed in accordance with the principles of the present invention. The finishing article constructed in accordance with the present invention may take many forms, such, for example, as grinding wheels, flap wheels, wire wheels, abrasive disks or pads, buffs or the like. For purposes of ease of illustration and clarity of description only a depressed center grinding wheel will be shown and described. It will, however, be understood by those skilled in the art that other disposable finishing articles which may be placed in compression during use thereof may be substituted for the grinding wheel without departing from the spirit or scope of the present invention.

As is shown in FIGS. 1 through 6, a depressed center grinding wheel 10 has a disposable drive member or hub assembly 12 permanently affixed thereto without the use of adhesives so that the grinding wheel may be attached to the threaded spindle 14 of an appropriate power tool 16 (only partially illustrated). According to the principles of the present invention, a disposable mounting hub or drive member is constructed in such a manner that when the grinding wheel is placed in operation upon the spindle 14 the grinding wheel 10 is placed in compression and the more force that is applied to the grinding wheel during utilization thereof, the greater the operational compression becomes. As a result of placing the grinding wheel in such compression the grinding wheel is maintained upon the spindle and at the same time, through the compression or clamping force, the grinding wheel 10 cannot rotate relative to the drive member or hub assembly 12. However, as a result of the construction of the drive member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized. However, when certain types of finishing articles are utilized such that the outer circumference or face is used instead of the entire face, then a depressed center may not be included in the article.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. Circular reinforcing ribs 32 and 34 ar formed in the backing flange 28 concentrically with the opening 30. Radial reinforcing ribs 33 are formed intersecting the concentric ribs 32 and 34. It has been found that the use of the radial ribs 33 on the backing flange 28 provides unexpected stiffness. Such stiffness is desired in certain applications of grinding wheels where large amounts of pressure are applied to the wheel during grinding. The backing flange 28 is preferably stamped from sheet metal but of course could be constructed from other materials such as hard molded plastic or die cast metal should such be desired.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes a land 40. The land 40 is formed about the outer peripheral portion of the backing flange 28. The land 40 always engages the back surface 18 of the abrasive finishing wheel away from the depressed center. In addition, a broken land 42 is formed by the inner surface 36 between the radial reinforcing ribs 33. The land 42 may engage the back surface of the abrasive finishing wheel 10 opposed the depressed center 22 thereof depending upon variations in wheel dimensions and manufacturing tolerances in the wheels and flanges.

As can be seen, particularly in FIG. 3, the ribs 32 and 34 formed in the outer surface 38 of the backing flange 22 are continuous. The continuous rib 32 is disposed between the lands 40 and 42 and over the transitional area between the depressed center and the remainder of the grinding wheel 10 while the continuous rib 34 is disposed intermediate the opening 30 and the land 42. Selected ones of the radial reinforcing ribs 33 have radially inwardly directed fingers 35, 37, 39 and 41 formed therein. Preferably, when the backing flange 28 is fabricated from stamped sheet metal the fingers 35, 37, 39 and 41 may be formed by cutting or punching the sheet metal during the stamping operation. When the fingers are formed a space is provided beneath the distal end 92, 94, 96 and 98 as shown at 100, 102, 104 and 106 respectively. The purpose and function of the gripping fingers will be described hereinafter.

As shown in FIG. 4, a retainer nut 44 includes a body portion 46 which is hollow and has a radially outwardly extending flange 48 at a first end 50 thereof. The internal surface of the body 46 has threads 56 formed therealong for attachment to the threaded spindle 14 of the power tool. The nut 44 is inserted through the aperture 26 in the grinding wheel and the aperture 30 in the flange 28 from the front surface 20 toward the rear surface 18 of the grinding wheel 10. The end 52 of the nut 44 extends through the opening 30 in the flange 28.

The nut 44 is preferably constructed from an aluminum extrusion which is then machined to provide the flange 38 and the threads 46. Alternatively the nut may be formed from aluminum or steel bar stock, or a metal die casting, or molded plastic.

Once the nut 44 has been inserted through the openings in the wheel 10 and the flange 28, the end 52 thereof is upset such as by a staking operation to provide a protrusion 56 extendinq outwardly therefrom as shown specifically in FIG. 5. The protrusion may be formed as a series of separate protrusions, or, as shown, as a continuous protrusion. Preferably the protrusion is formed by a staking operation which forms a continuous groove 54 in the end of 52 of the nut 44. Formation of the groove 54 causes the displaced material to form a lip or overhang 57 which will overlie the back of the backing flange 28 about the opening 30 therethrough. It should become apparent to those skilled in the art that the flange 28 and the nut 44 are secured together on the wheel 10 between the flange 48 and the overhang 57 without the use of adhesives.

To provide proper operational compressive forces of the throwaway grinding wheel as above-described, a pressure cap 60 is rotated into locking engagement with the hub assembly 12. The pressure cap 60 includes a first or rear surface 62 for engaging a surface 64 on the power tool spindle when the grinding wheel is in an operable position on the power tool 16. A second or front surface 66 on the pressure cap 60 contacts the top of the continuous rib 34. The pressure cap 60 is retained in position on the hub assembly 12 by a plurality of radially outwardly extending tangs 68, 70, 72 and 74. These tangs extend outwardly from a surface 70 on the body 76 of the pressure cap 60. The surface 70 is defined by a circular wall 78 which is connected to the rear surface 62 by a plurality of radial walls 80.

As is more easily seen in FIG. 8, each of the tangs 68 through 74 includes a wedge shaped portion 82 with the thinner section 84 thereof at the leading edge. A surface 86 defines an inclined plane or ramp which is used in securing the pressure cap 60 on the flange 28. Adjacent the thickest portion 88 of the wedge shaped portion 82 is a stop member 90. The stop member 90 defines a detent 92.

Once the flange 28 and the retaining nut 44 are secured upon the wheel 10 the pressure cap 60 is secured thereon in the following manner: Tangs 68 through 74 are positioned between fingers 35 through 41 with the surface 66 engaging the rib 34. The cap 60 is then rotated clockwise so that the leading edge 84 of the tangs enters the spaces 100 through 106. Rotation is continued to effect an interference fit between the ramp 86 and the finger associated therewith. Finally, the distal end 92 through 98 of the fingers will be positioned within the detent 92 of its respective stop member as more specifically shown in FIG. 9. It will be noted particularly in FIG. 1 that the reinforcing rib 34 has a predetermined radius of curvature and that the surface 66 of the pressure cap has a complimentary radius of curvature. Thus, when the two are brought into engagement and secured together, forces are easily transmitted through the body 76.

From the drawings, it is noted that there are an equal number of fingers and tangs and that they are equiangularly spaced. Although such an arrangement will usually be preferred, it must be understood that it is not necessary. For example, there may be a greater or lesser number of tangs and fingers and they need not be equiangularly disposed. It should be recognized that the sole function of the tangs and fingers is to secure the pressure cap to the flange. Once secured, the tangs and fingers do not transmit or carry loads of any kind.

The body 76 of the pressure cap 60 defines an aperture 110 for receiving the spindle 14 of the power tool. When assembled on the backing flange 28 the apertures 26 30 and 110 are aligned axially. As will be noted, when the grinding wheel is in use on the power tool compressive forces are transmitted through the body 76 of the pressure cap 60 between the surfaces 62 and 66. The bulk of the body 76 between surfaces 62 and 66 and the stiffening ribs or radial walls 80 carry these forces. Preferably the pressure cap 60 is constructed of molded plastic such as polypropylene, nylon, acetal or the like. The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the spindle seat 64. The interengagement between the threads 14 and 56 of the spindle and nut, respectively, urge the nut upward toward the flange 28 as the wheel is seated upon the spindle. At the same time, the spindle seat 64 applies a downward force to surface 62 of the pressure cap 60 which in turn, through the surface 66 applies a downward force to the flange 28. Therefore, this mutual clamping force causes the grinding wheel to be placed in compression. Those skilled in the art will recognize that as the grinding wheel 10 is used by being placed against a workpiece, additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. However, through the use of the plastic pressure cap the wheel easily releases from the power tool with hand force only when rotated in the opposite direction. It will be recognized by those skilled in the art that the grinding wheel assembly as illustrated in FIGS. 1 through 9 and as above described require no adhesive for construction and may be simply and easily assembled, is relatively light in weight as compared to the prior art devices utilizing the cast hubs and provides a secure attachment of the finishing article to the power tool and through the utilization of the increased compression precludes relative rotation of the finishing article with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Through the structure as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable finishing article driving member assembly which securely holds the article during operation, which is light in weight, vibration-free, and less expensive than prior art throw-away articles while meeting all safety standards currently known and in existence.

What is claimed is:

1. A finishing device having a disposable drive member non-removably affixed thereto for mounting on a threaded rotatable spindle of a power tool comprising:

a finishing article having a face and a back and having a first centrally disposed aperture therethrough;

a backing flange having an inner and outer surface and a diameter smaller than the diameter of said finishing article, said backing flange defining a second centrally disposed aperture therethrough, and a plurality of fingers extending radially inwardly from said outer surface thereof and defining a space therebeneath, said first and second apertures being aligned;

a retaining nut having a hollow internally threaded body having first and second ends and a first radially outwardly extending flange extending from said first end of said body, said body extending through said first and second apertures with said radial flange seated against one of said face and back;

means protruding outwardly from said second end of said body to non-removably secure said retaining nut and said backing flange together on said wheel without the use of adhesives; and pressure cap means defining a centrally disposed opening therethrough secured to said fingers extending radially inwardly from said backing flange to apply force to said backing flange when said finishing article is secured on said spindle to cause said backing flange and said retaining nut to move toward each other to compress said finishing article therebetween as operative loads are applied to said article during use on said power tool, said pressure cap including a molded plastic member having a plurality of radially outwardly extending tangs, each of said tangs having a wedge shaped portion adapted to be received under one of said fingers for securing said cap to said backing flange.

2. A finishing device as defined in claim 1 wherein said wedge shaped portion includes a surface defining an inclined ramp.

3. A finishing device as defined in claim 2 wherein said inclined ramp is continuous along said tang thereby resulting in said tang becoming continuously thicker in elevation.

4. A finishing device as defined in claim 3 wherein said pressure cap further includes a cap body having an outer surface with said tangs extending radially outwardly adjacent a terminus of said outer surface.

5. A finishing device as defined in claim 4 wherein said cap body includes a first surface for engaging said spindle and a second surface for engaging said backing flange when said pressure cap is secured to said finishing device.

6. A finishing device as defined in claim 5 wherein said outer surface of said backing flange includes a circular reinforcing rib extending therefrom and wherein said second surface of said cap body engages said reinforcing rib.

7. A finishing device as defined in claim 2 wherein said pressure cap further includes a cap body having an outer surface with said tangs extending from said outer surface and which further includes stop means on said outer surface adjacent each said tang for receiving one of said fingers.

8. A finishing device as defined in claim 1 wherein said backing flange includes a first circular reinforcing rib extending from the outer surface thereof and a plurality of radial reinforcing ribs intersecting and extending from said first circular reinforcing rib.

9. A finishing device as defined in claim 8 wherein said backing flange further includes a second circular reinforcing rib concentric with said first rib and displaced radially outwardly therefrom, said radial reinforcing ribs intersecting said second circular reinforcing rib.

10. A finishing device as defined in claim 9 wherein said cap body includes a first surface for engaging said spindle and a second surface for engaging said first reinforcing rib.

11. A finishing device having a disposable drive member non-removably affixed thereto for mounting on a threaded rotatable spindle of a power tool comprising:

a finishing article having a face and a back and having a first centrally disposed aperture therethrough;

a backing flange having an inner and outer surface and a diameter smaller than the diameter of said finishing article, said backing flange defining a second centrally disposed aperture therethrough, and a plurality of fingers extending radially inwardly from said outer surface thereof and defining a space therebeneath, said first and second apertures being aligned;

a retaining nut having a hollow internally threaded body having first and second ends and a first radially outwardly extending flange extending from said first end of said body, said body extending through said first and second apertures with said radial flange seated against one of said face and back;

means protruding outwardly from said second end of said body to non-removably secure said retaining nut and said backing flange together on said wheel without the use of adhesives; and pressure cap means defining a centrally disposed opening therethrough secure to said fingers extending radially inwardly from said backing flange to apply force to said backing flange when said finishing article is secured on said spindle to cause said backing flange and said retaining nut to move toward each other to compress said finishing article therebetween as operative loads are applied to said article during use on said power tool, said pressure cap including a molded plastic member having a cap body having an outer surface having a plurality of radially outwardly extending tangs, each of said tangs having a wedge shaped portion including a surface defining an inclined ramp adapted to be received under one of said fingers for securing said cap to said back flange, said outer surface also having stop means defining a detent adjacent each said tang receiving a distal end of one of said fingers.

12. A finishing device as defined in claim 11 wherein said cap body includes a first surface for engaging said spindle and a second surface for engaging said backing flange when said pressure cap is secured to said finishing device, said backing flange outer surface defining a reinforcing rib having a predetermined radius of curvature, said second surface of said cap body having a surface defining a radius of curvature substantially complimentary to that of said rib.

13. A finishing device as defined in claim 12 wherein said tangs are equiangularly disposed about said pressure cap body.

14. A finishing device as defined in claim 13 wherein said tangs and said fingers are equal in number with a tang being received within each space beneath each said finger when said pressure cap is secured upon said finishing device.

* * * * *